US010920475B2

(12) United States Patent
Sato

(10) Patent No.: US 10,920,475 B2
(45) Date of Patent: Feb. 16, 2021

(54) SLIDING-DOOR CLOSER SET

(71) Applicant: Sugatsune Kogyo Co., Ltd., Tokyo (JP)

(72) Inventor: Genichi Sato, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 15/122,138

(22) PCT Filed: Feb. 16, 2015

(86) PCT No.: PCT/JP2015/054075
§ 371 (c)(1),
(2) Date: Aug. 26, 2016

(87) PCT Pub. No.: WO2015/129494
PCT Pub. Date: Sep. 3, 2015

(65) Prior Publication Data

US 2016/0369547 A1 Dec. 22, 2016

(30) Foreign Application Priority Data

Feb. 28, 2014 (JP) ..... 2014-038193

(51) Int. Cl.
*E05F 3/18* (2006.01)
*E05F 1/16* (2006.01)
(Continued)

(52) U.S. Cl.
CPC ..... *E05F 3/18* (2013.01); *E05D 15/063* (2013.01); *E05D 15/0652* (2013.01); *E05F 1/16* (2013.01);
(Continued)

(58) Field of Classification Search
CPC ..... E05F 3/18; E05F 3/02; E05F 1/16; E05D 15/063; E05D 15/0652
See application file for complete search history.

(56) References Cited

U.S. PATENT DOCUMENTS 8,151,413 B2 * 4/2012 Iwaki ..... E05F 11/08 16/49
8,726,574 B2 * 5/2014 Iwaki ..... E05F 1/16 16/49
(Continued)

FOREIGN PATENT DOCUMENTS

CN 2913553 Y 6/2007
DE 10 2011 075 778 B3 6/2012
(Continued)

OTHER PUBLICATIONS

SIPO Examiner, First Office Action issued in Chinese Patent Application No. 201580003256.0 (with translation).
(Continued)

*Primary Examiner* — Jeffrey O'Brien
(74) *Attorney, Agent, or Firm* — Masuvalley & Partners

(57) ABSTRACT

Provided is a sliding door closer set which makes it possible to adjust the position of a trigger arranged inside a door pocket from outside of the door pocket. A sliding door closer set comprises a rail (4), a closer (6) hanging a sliding door (1) and being capable of moving along the rail (4), and a trigger (8) arranged inside the door pocket (2), wherein the sliding door (1) is pulled into the door pocket (2) as a result of engagement between the trigger (8) and the closer (6), which has moved to a predetermined position on the rail (4). The trigger (8) arranged inside the door pocket (2) is integrally connected to a trigger integrated plate (10). The trigger integrated plate (10) is mounted to the rail (4) outside the door pocket (2).

6 Claims, 12 Drawing Sheets

(51) Int. Cl.

| | |
|---|---|
| ***E05D 15/06*** | (2006.01) |
| ***E05F 3/02*** | (2006.01) |
| ***E05F 5/00*** | (2017.01) |
| ***E06B 3/46*** | (2006.01) |

(52) U.S. Cl.
CPC ..... *E05F 3/02* (2013.01); *E05F 5/003* (2013.01); *E06B 3/4654* (2013.01); *E05Y 2600/12* (2013.01); *E05Y 2900/14* (2013.01)

(56) References Cited

U.S. PATENT DOCUMENTS

| | | | | |
|---|---|---|---|---|
| 8,793,839 | B2 * | 8/2014 | Iwaki | E05F 1/16 16/49 |
| 2011/0099909 | A1 * | 5/2011 | Stommel | E05F 1/16 49/413 |
| 2013/0160240 | A1 | 6/2013 | Kenny | |
| 2013/0219657 | A1 * | 8/2013 | Iwaki | E05F 1/16 16/64 |
| 2017/0067277 | A1 * | 3/2017 | Janzen | E05F 5/003 |
| 2017/0130501 | A1 * | 5/2017 | Svara | E05F 3/00 |

FOREIGN PATENT DOCUMENTS

| | | | |
|---|---|---|---|
| FR | 2961245 | A1 | 12/2011 |
| JP | 2006-169723 | A | 6/2006 |
| JP | 2013-049946 | A | 3/2013 |
| JP | 5285679 | B2 | 9/2013 |
| JP | 2014-025237 | A | 2/2014 |

OTHER PUBLICATIONS

WIPO, Japan International Search Authority, International Search Report (with translation) and Written Opinion dated May 12, 2015 in International Patent Application No. PCT/JP2015/054075, 6 pages.

EPO, Supplementary European Search Report dated Oct. 26, 2017 in corresponding EP Patent Application No. EP15754654.0, 5 pages.

* cited by examiner

Cross-Sectional View Along Line III-III

Cross-Sectional View Along Line IV-IV

Cross-Sectional View Along Line IV-IV

SLIDING-DOOR CLOSER SET

RELATED APPLICATIONS

This application is the U.S. National Phase of and claims priority to International Patent Application No. PCT/JP2015/054075, International Filing Date Feb. 16, 2015, entitled Sliding-Door Closer Set; which claims benefit of Japanese Application No. JP2014-038193 filed Feb. 28, 2014; both of which are incorporated herein by reference in their entireties.

TECHNICAL FIELD

The present invention relates to a sliding door closer set for pulling a sliding door in at least one direction of a door leading edge and a door trailing edge, and more particularly relates to a door pocket type sliding door closer set in which a sliding door is stored in a door pocket.

BACKGROUND ART

A sliding door closer set comprises a rail mounted at the top of a frame of a building; a closer capable of moving along the rail; and a trigger mounted to a predetermined position on the rail (for example, see Patent Document 1: JP 5285679 B). A sliding door is hung from the closer. When the sliding door is moved to the predetermined position at the door leading edge side and/or the door trailing edge side, the closer engages with the trigger, and the closer operates. The closer pulls the sliding door in at least one direction of the door leading edge and the door trailing edge. The dynamic force to pull the sliding door by the closer is an elastic force of a spring such as a coil spring provided inside the closer. A damper is incorporated in the closer such that the sliding door opens and closes slowly and quietly.

SUMMARY OF THE INVENTION

Problem to be Solved by the Invention

Sliding door closer sets are used in various settings. For example, in hotels, hospitals, residences, and the like, door pocket type sliding doors which store a sliding door in a door pocket when the sliding door is opened are used, and in some cases, a sliding door closer set is used for this door pocket type sliding door. In this case, a trigger is arranged inside the door pocket in order to pull the sliding door into the door pocket.

However, because the trigger is arranged inside the door pocket, if a mistake is made with the mounting position of the trigger due to a construction error, or if the trigger is mounted at an incline, the trigger position or incline cannot be corrected without demolishing the door pocket, which is a problem. If the door pocket is embedded in a wall, the wall may even have to be demolished. There are some examples in which the trigger is not arranged inside the door pocket in order to avoid construction errors at actual construction sites. However, if the trigger is not arranged inside the door pocket, the sliding door cannot be pulled into the door pocket.

Therefore, it is an object of the present invention to provide a sliding door closer set in which the position of a trigger arranged inside a door pocket can be adjusted from outside of the door pocket.

Means to Solve the Problem

In order to solve the above-mentioned problem, according to one aspect of the present invention, there is provided a sliding door closer set comprising a rail arranged partially inside a door pocket; a closer hanging a sliding door and being capable of moving along the rail; and a trigger arranged inside the door pocket; wherein the sliding door is pulled into the door pocket as a result of engagement between the trigger and the closer, which has moved to a predetermined position on the rail; and the sliding door closer set further comprises a trigger integrated plate mounted to the rail outside the door pocket and integrally connected to the trigger arranged inside the door pocket.

According to a preferable aspect of the present invention, a guide unit for guiding the trigger integrated plate is formed in the rail such that the trigger integrated plate can be inserted into and removed from an inner rail.

According to a more preferable aspect of the present invention, the rail comprises an outer rail located outside the door pocket and an inner rail located inside the door pocket; and the trigger integrated plate straddles a boundary line between the outer rail and the inner rail.

Effects of the Invention

According to one aspect of the present invention, the position of the trigger arranged inside the door pocket can be adjusted from outside of the door pocket.

According to the preferable aspect of the present invention, hanging down of the trigger integrated plate at the rail inside the door pocket can be prevented. Moreover, because the trigger can be removed to outside of the door pocket, a maintenance and inspection of the trigger can be performed.

According to the more preferable aspect of the present invention, a centering operation to match the center line of the outer rail with the center line of the inner rail is simplified.

BRIEF DESCRIPTION OF THE DRAWINGS

(FIG. 8A shows a state in which an inner rail is mounted to a door pocket, and FIG. 8B shows a state in which a trigger integrated plate is inserted into an inner rail.)

(FIG. 12A shows a plan view of the closer, and FIG. 12B shows a side view of the closer).

(FIG. 13A shows a plan view, and FIG. 13B shows a side view).

EMBODIMENT FOR CARRYING OUT THE INVENTION

Figure 1:
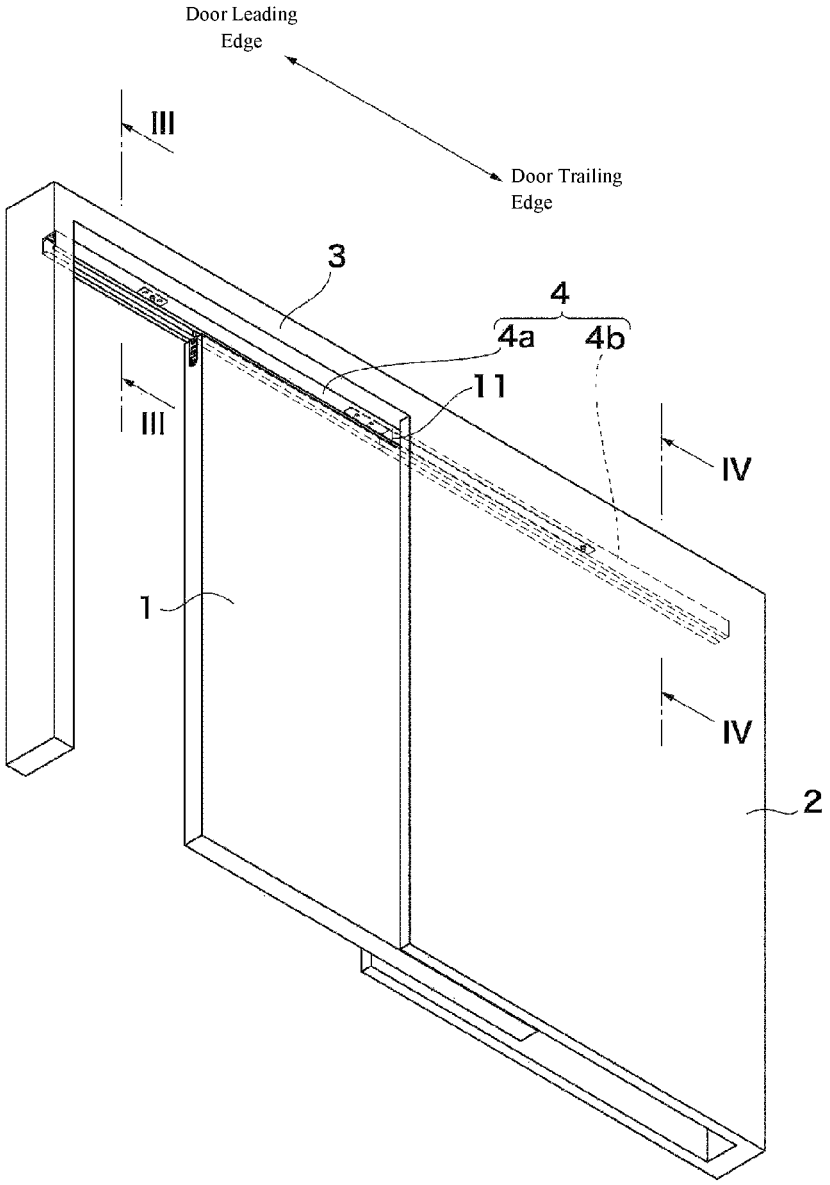
FIG. 1 is a perspective view of a sliding door closer set according to one embodiment of the present invention.

A sliding door closer set according to an embodiment of the present invention is described below based on the attached drawings. The sliding door closer set according to the present embodiment is assembled with a door pocket type sliding door. FIG. 1 shows a perspective view of the sliding door closer set, and FIG. 2 shows an exploded perspective view of the sliding door closer set.

As shown in FIG. 1, a sliding door 1 is hung from a rail 4 mounted to an upper frame 3 such that the sliding door 1 is capable of moving in the door leading edge direction and the door trailing edge direction. When opened, the sliding door 1 is stored in a door pocket 2.

Figure 2:
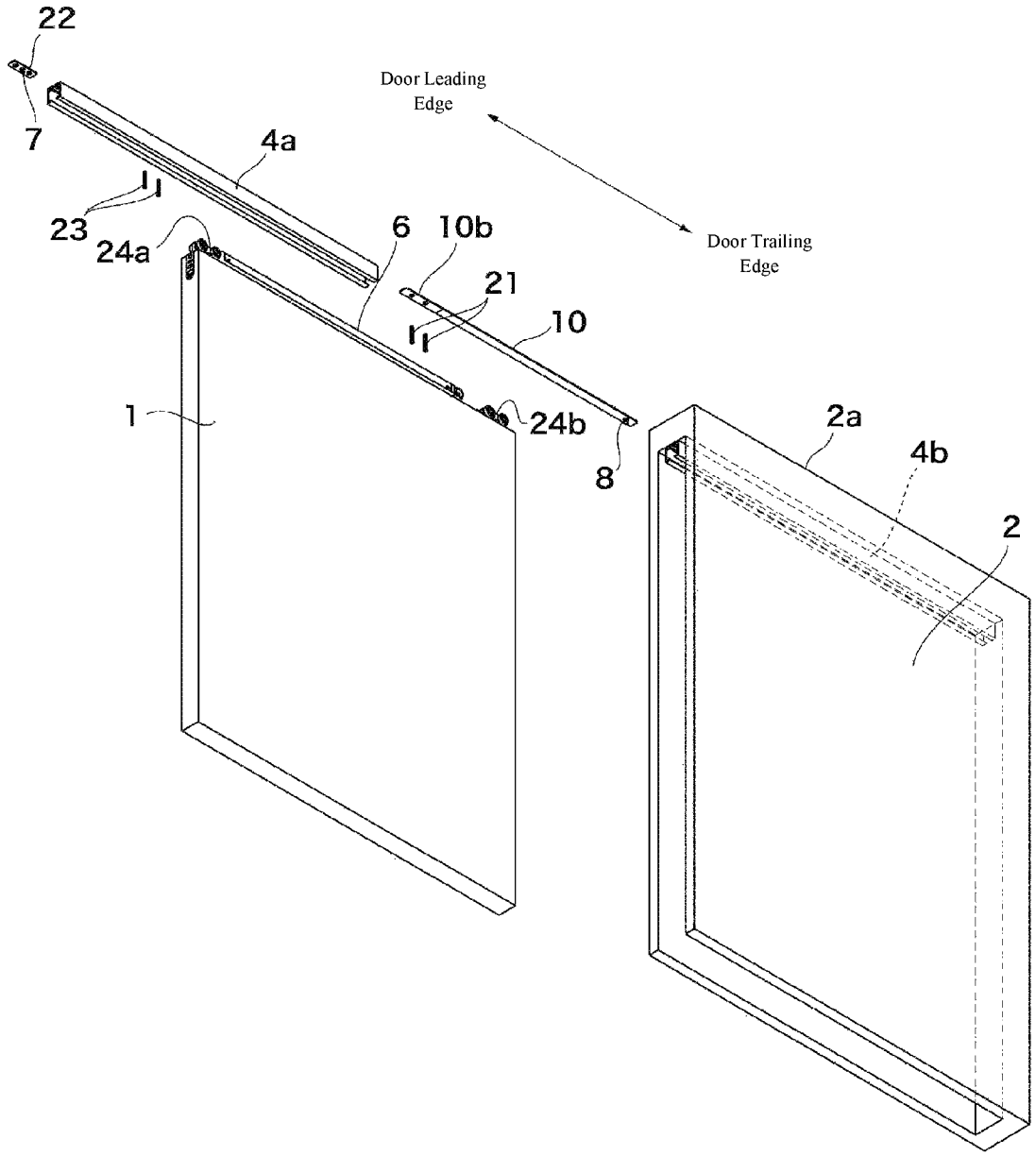
FIG. 2 is an exploded perspective view of the sliding door closer set according to the embodiment of the present invention.

As shown in FIG. 2, the sliding door closer set comprises the rail 4 (an outer rail 4*a*, an inner rail 4*b*), a closer 6, a trigger (a door leading edge side trigger 7, a door trailing edge side trigger 8), and a trigger integrated plate 10. The rail 4 comprises an inner rail 4*b* inside the door pocket 2 and an outer rail 4*a* outside the door pocket 2. The inner rail 4*b* is mounted to an upper frame 2*a* of the door pocket 2, and the outer rail 4*a* is mounted to an upper frame 3 (see FIG. 1) outside the door pocket 2. A boundary line 11 (see FIG. 1) between the inner rail 4*b* and the outer rail 4*a* is positioned at an end part in the door leading edge direction of the door pocket 2.

The closer 6 according to the present embodiment is a dual type closer 6 which pulls the sliding door 1 in both the door leading edge direction and the door trailing edge direction. Namely, when the sliding door 1 is moved to a predetermined position in the door leading edge direction by human hands, the closer 6 automatically pulls the sliding door 1 to a closed position (a position where the sliding door 1 abuts a vertical frame). Moreover, when the sliding door 1 is moved to a predetermined position in the door trailing edge direction by human hands, the closer 6 automatically pulls the sliding door 1 to an opened position (a position where the sliding door 1 is stored inside the door pocket 2). A damper for opening and closing the sliding door 1 slowly and quietly is incorporated in the closer 6.

According to the present embodiment, a door leading edge side trigger 7 and a door trailing edge side trigger 8 are provided. The door leading edge side trigger 7 is for pulling the sliding door 1 in the door leading edge direction. The door trailing edge side trigger 8 is for pulling the sliding door 1 into the door pocket 2. The door leading edge side trigger 7 is arranged at the outer rail 4*a*. The door trailing edge side trigger 8 is arranged at the inner rail 4*b* inside the door pocket 2. The trigger 8 is integrally connected to the trigger integrated plate 10.

Figure 3:
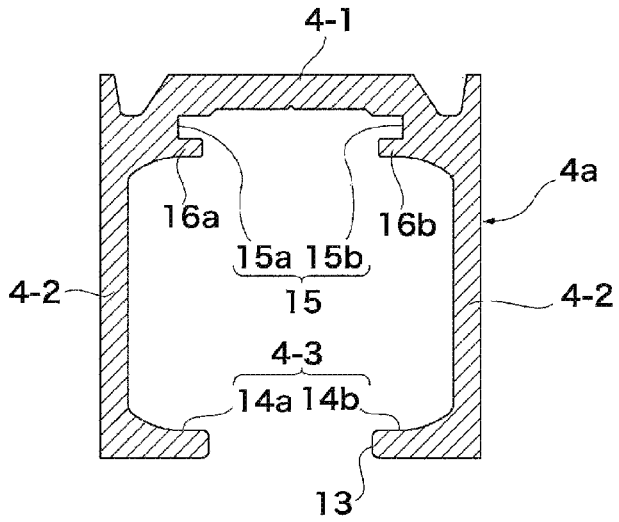
FIG. 3 is a cross-sectional view (along the line of FIG. 1) of an outer rail.
Figure 5:
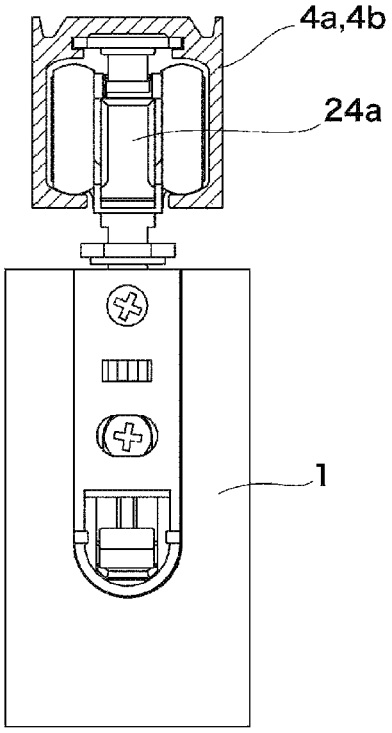
FIG. 5 is a cross-sectional view along the line IV-IV of FIG. 1.

Each constituent element of the sliding door closer set is described below in order. FIG. 3 shows a cross-sectional view of the outer rail 4*a*. The cross-sectional shape of the outer rail 4*a* is a substantially square shape, and the outer rail 4*a* comprises an upper wall 4-1, a pair of left and right side walls 4-2, and a bottom wall 4-3. The closer 6 is inserted into the inside of the outer rail 4*a*. An opening 13 penetrated by a hanging tool of the sliding door 1 is formed in the bottom wall 4-3 of the outer rail 4*a*. The bottom wall 4-3 comprises a pair of base part rails 14*a*, 14*b* sandwiching the opening 13. A traveling body 24*a* of the closer 6 travels on the base part rails 14*a*, 14*b* (see FIG. 5). A guide unit 15 is formed at the upper wall 4-1 of the outer rail 4*a* such that the trigger integrated plate 10 can be inserted and can be removed. The guide unit 15 comprises a pair of guide grooves 15*a*, 15*b* into which both end parts in the width direction of the trigger integrated plate 10 are inserted. Projections 16*a*, 16*b* configuring the guide grooves 15*a*, 15*b* project toward the inside of the outer rail 4*a*, and prevent the trigger integrated plate 10 from falling off.

Figure 4:
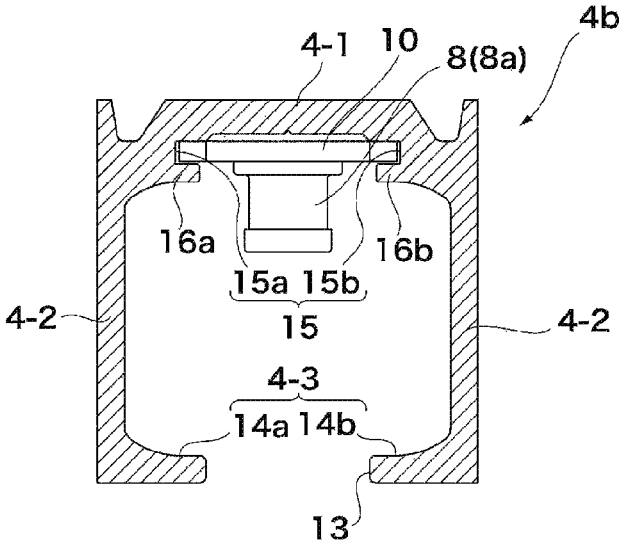
FIG. 4 is a cross-sectional view (along the line IV-IV of FIG. 1) of an inner rail.

FIG. 4 shows a cross-sectional view of the inner rail 4*b*. The cross-sectional shape of the inner rail 4*b* is the same as the cross-sectional shape of the outer rail 4*a*, and the inner rail 4*b* comprises an upper wall 4-1, a pair of right and left side walls 4-2, and a bottom wall 4-3. An opening 13 penetrated by a hanging tool of the sliding door 1 is formed in the bottom wall 4-3 of the inner rail 4*b*, and a pair of base part rails 14*a*, 14*b* sandwiching the opening 13, on which the traveling body 24*a* of the closer 6 travels, is also formed. A guide unit 15 is formed at the upper wall 4-1 of the inner rail 4*b* such that the trigger integrated plate 10 can be inserted and can be removed. The guide unit 15 comprises a pair of guide grooves 15*a*, 15*b* into which both end parts in the width direction of the trigger integrated plate 10 are inserted. Projections 16*a*, 16*b* configuring the guide grooves 15*a*, 15*b* project toward the inside of the inner rail 4*b*, and prevent the trigger integrated plate 10 from falling off.

Figure 6:
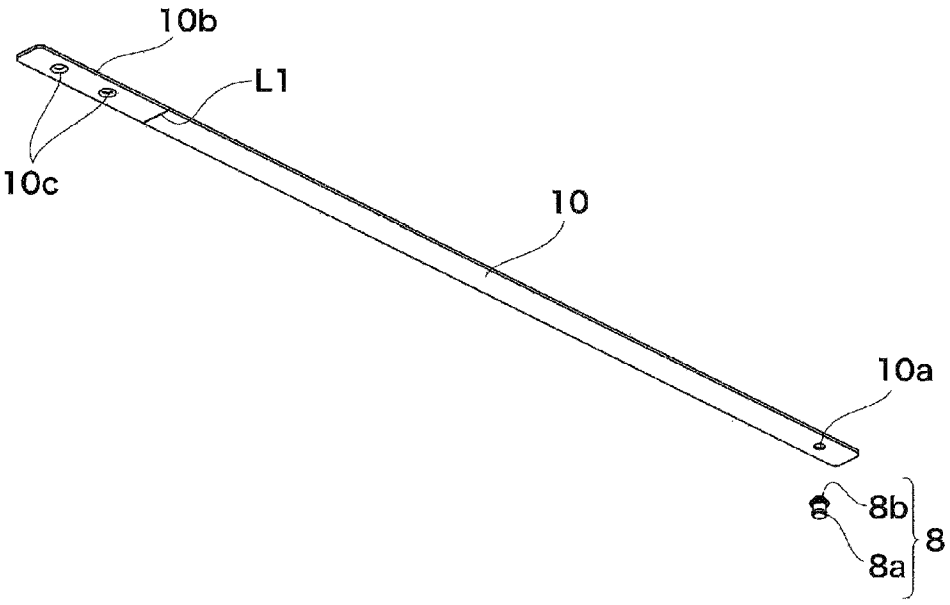
FIG. 6 is a perspective view of a trigger and trigger integrated plate.

FIG. 6 shows a perspective view of the door trailing edge side trigger 8 and the trigger integrated plate 10. The trigger 8 is a substantially cylindrical shape. The trigger 8 comprises a main body part 8*a* abutting the closer 6 (see FIG. 4) and a shaft part 8*b* fixed to the trigger integrated plate 10. The trigger 8 is connected to the trigger integrated plate 10 by inserting the shaft part 8*b* of the trigger 8 into a through hole 10*a* of the trigger integrated plate 10 and caulking the shaft part 8*b*. Note that the trigger 8 may be connected to the trigger integrated plate 10 by forming a male screw on the shaft part 8*b* of the trigger 8 and screwing the male screw into the through hole 10*a* of the trigger integrated plate 10.

The trigger integrated plate 10 is formed in a long and narrow plate shape in the length direction of the rail 4. The above-mentioned through hole 10*a* is machined in one end part in the length direction of the trigger integrated plate 10, and the trigger 8 is connected to this through hole 10*a*. A plurality of mounting holes 10*c* are machined in the other end part (a mounting part 10*b*) in the length direction of the trigger integrated plate 10. The mounting part 10*b* of the trigger integrated plate 10 is mounted to the outer rail 4*a* by a fastening member 21 (see FIG. 2) such as a screw. A large portion of the trigger integrated plate 10 is inserted into the inner rail 4*b*. The mounting part 10*b* of the trigger integrated plate 10 exits to the outside of the inner rail 4*b*, and is inserted into the outer rail 4*a*. The line L1 of FIG. 6 represents a boundary line between the inner rail 4*b* and the outer rail 4*a*.

As shown in FIG. 2, the door leading edge side trigger 7 for pulling the sliding door 1 in the door leading edge direction is mounted to the outer rail 4*a*. This door leading edge side trigger 7 is integrally connected to a plate 22 in which a through hole is formed. The door leading edge side trigger 7 is fixed to the outer rail 4*a* by a fastening member 23 such as a screw.

As shown in FIG. 2, the sliding door 1 is hung by the pair of traveling bodies 24*a*, 24*b* arranged at the end parts in the door leading edge and door trailing edge directions. Each of the traveling bodies 24*a*, 24*b* comprises a total of four door rollers. The closer 6 is connected to the one traveling body 24*a*. The closer 6 and the traveling bodies 24*a*, 24*b* are inserted into the outer rail 4*a* and the inner rail 4*b*, and slide inside the outer rail 4*a* and the inner rail 4*b*.

Figure 7:
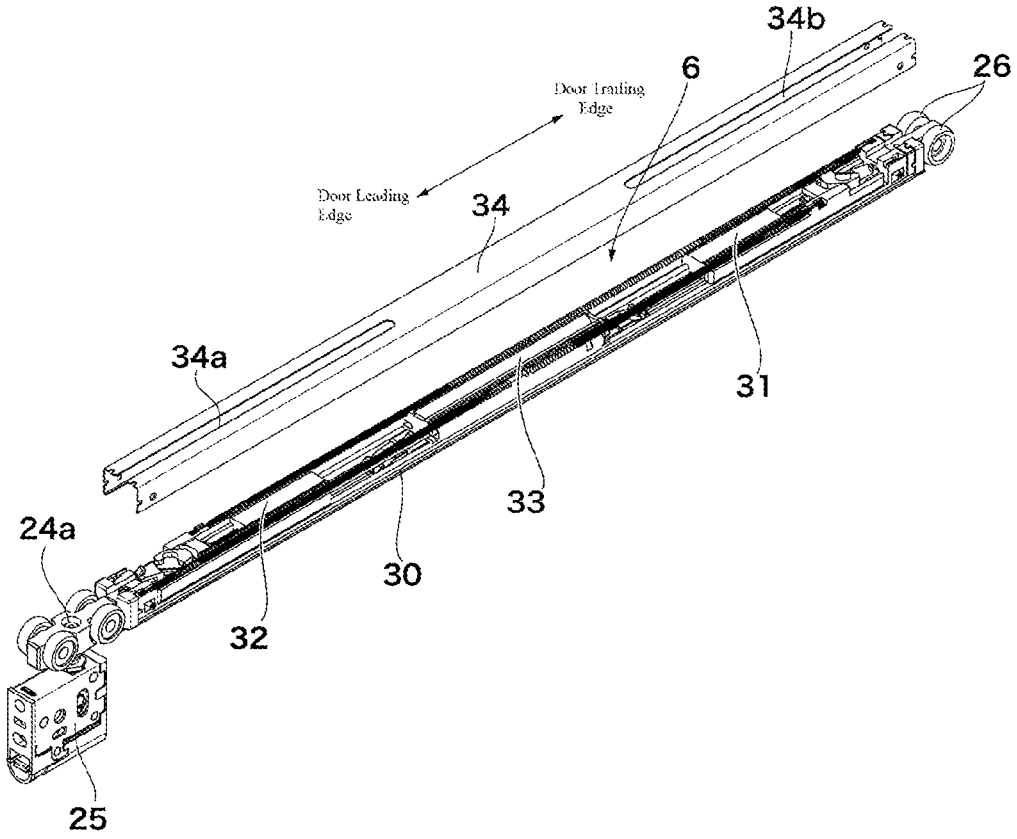
FIG. 7 is a perspective view of a closer.

FIG. 7 shows a perspective view of the closer 6 connected to the traveling body 24*a*. The sliding door 1 is hung by the traveling body 24*a* via a position adjustment unit 25. The position adjustment unit 25 adjusts the position of the sliding door 1 in the vertical direction and the width direction. Door rollers 26 are mounted to an end in the length direction of the closer 6.

The closer 6 comprises a long and narrow base 30 in the length direction of the rail 4, a first slider assembly 31 incorporated so as to be slidable in the length direction of the base 30, a second slider assembly 32 incorporated so as to be slidable in the length direction of the base 30, and a damper assembly 33 arranged between the first slider assembly 31 and the second slider assembly 32. The first slider assembly 31 generates a pulling force to pull the sliding door 1 in the door trailing edge direction. The second slider assembly 32 generates a pulling force to pull the sliding door 1 in the door leading edge direction. The damper assembly 33 generates a damping force such that the sliding door 1 is pulled slowly and quietly. The structures of the first slider assembly 31, the second slider assembly 32, and the damper assembly 33 are described below. The closer 6 is covered by a cover 34. Slits 34*a*, 34*b* for receiving the door leading edge side trigger 7 and the door trailing edge side trigger 8 are formed in the cover 34.

Figure 8A:
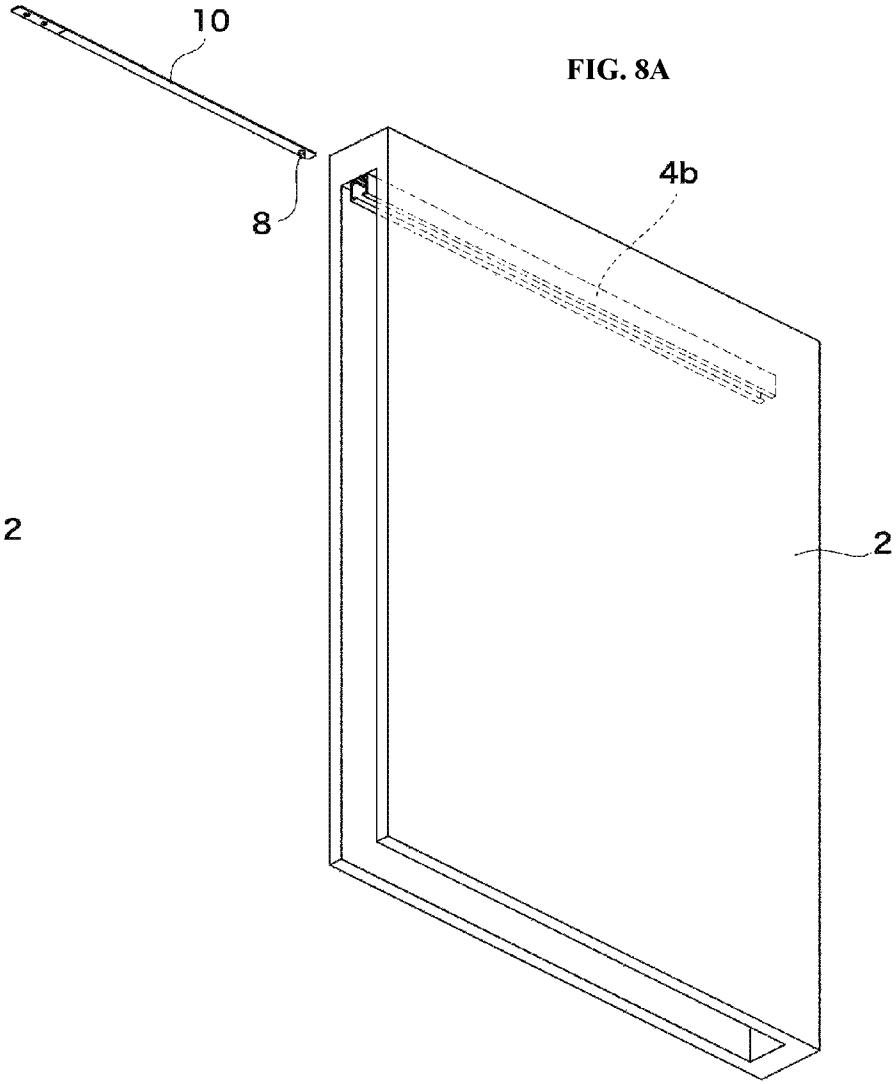
FIGS. 8A and 8B are process drawings showing a method for mounting a sliding door closer set.

The method for installing the sliding door closer set according to the present embodiment is described with reference to FIGS. 8 to 11. First, as shown in FIG. 8A, the inner rail 4*b* is mounted inside the door pocket 2. The inner rail 4*b* is mounted simultaneously with assembly of the door pocket 2. After the door pocket 2 is assembled, it is difficult to mount the inner rail 4*b*.

Next, the trigger integrated plate 10 to which the trigger 8 is connected is prepared. The trigger 8 may be connected in advance to the trigger integrated plate 10, or the trigger 8 may be fixed to the trigger integrated plate 10 by being caulked or screwed at a construction site. Next, the trigger integrated plate 10 is inserted into the guide unit 15 of the outer rail 4*a*. Note that the outer rail 4*a* is omitted in FIG. 8A.

Figure 8B:
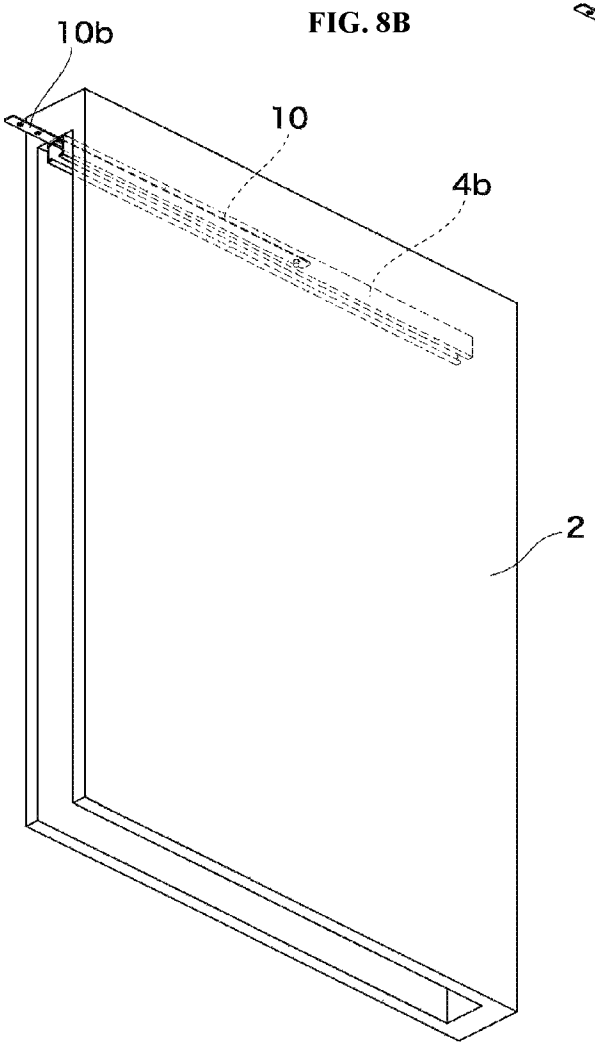

Next, as shown in FIG. 8B, the trigger integrated plate 10 is inserted into the inner rail 4*b*. At this time, the trigger integrated plate 10 is guided by the guide unit 15 of the inner rail 4*b*.

Figure 9:
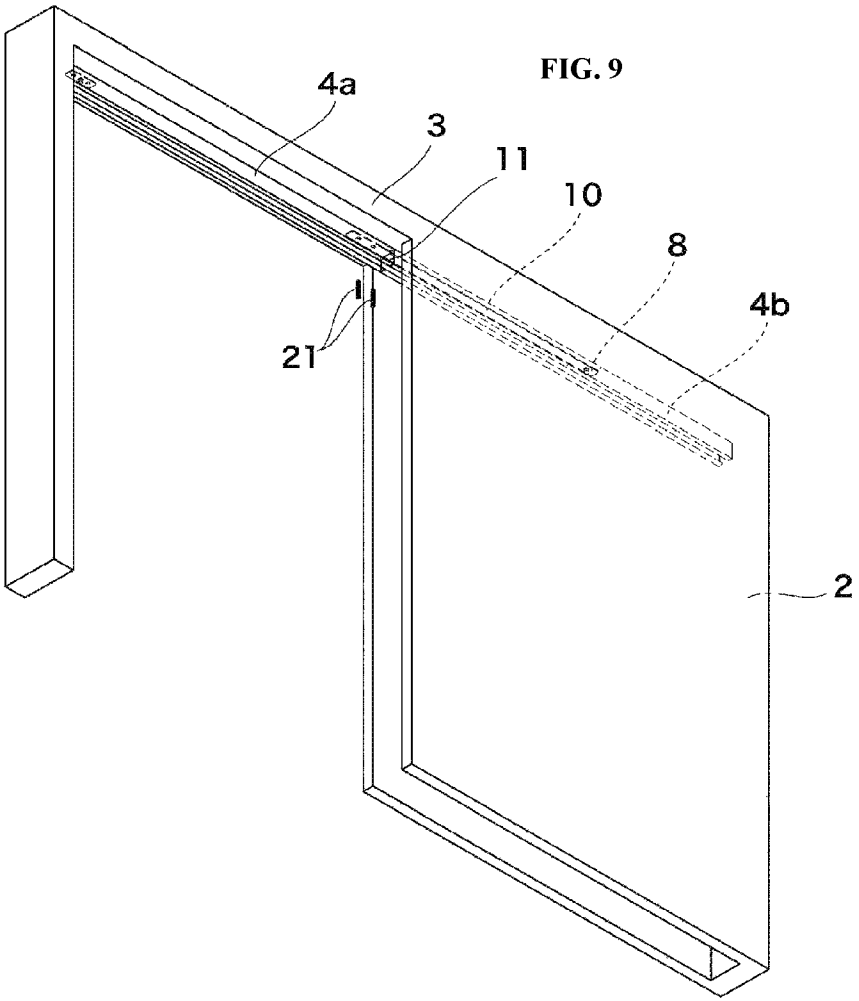
FIG. 9 is a process drawing showing the method for mounting a sliding door closer set (a state in which a trigger integrated plate is mounted to an outer rail).

Next, as shown in FIG. 9, the outer rail 4*a* is mounted to the upper frame 3 by a fastening member 27 (see FIG. 10) such as a screw. The trigger integrated plate 10 straddles the boundary line 11 between the inner rail 4*b* and the outer rail 4*a*, and therefore centering of the inner rail 4*b* and the outer rail 4*a* is performed. Once the position of the trigger 8 inside the door pocket 2 has been adjusted, the trigger integrated plate 10 is mounted to the outer rail 4*a* by the fastening member 21. Next, the door front end side trigger 7 is mounted at a predetermined position on the outer rail 4*a* by the fastening member 23 (see FIG. 2). Note that while not illustrated in FIG. 9, when the outer rail 4*a* is mounted to the upper frame 3, the closer 6 is inserted into the outer rail 4*a* in advance.

Figure 10:
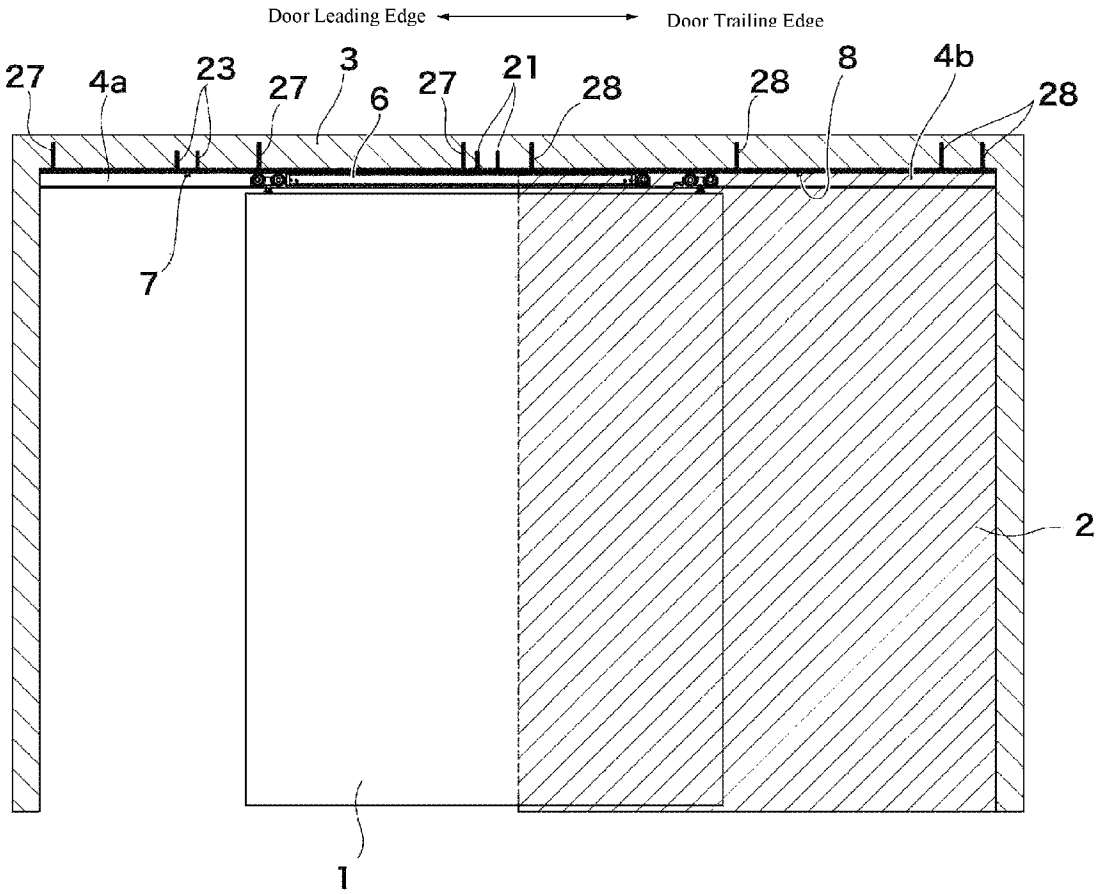
FIG. 10 is a cross-sectional view of a door pocket type sliding door assembled with a sliding door closer set.
Figure 11:
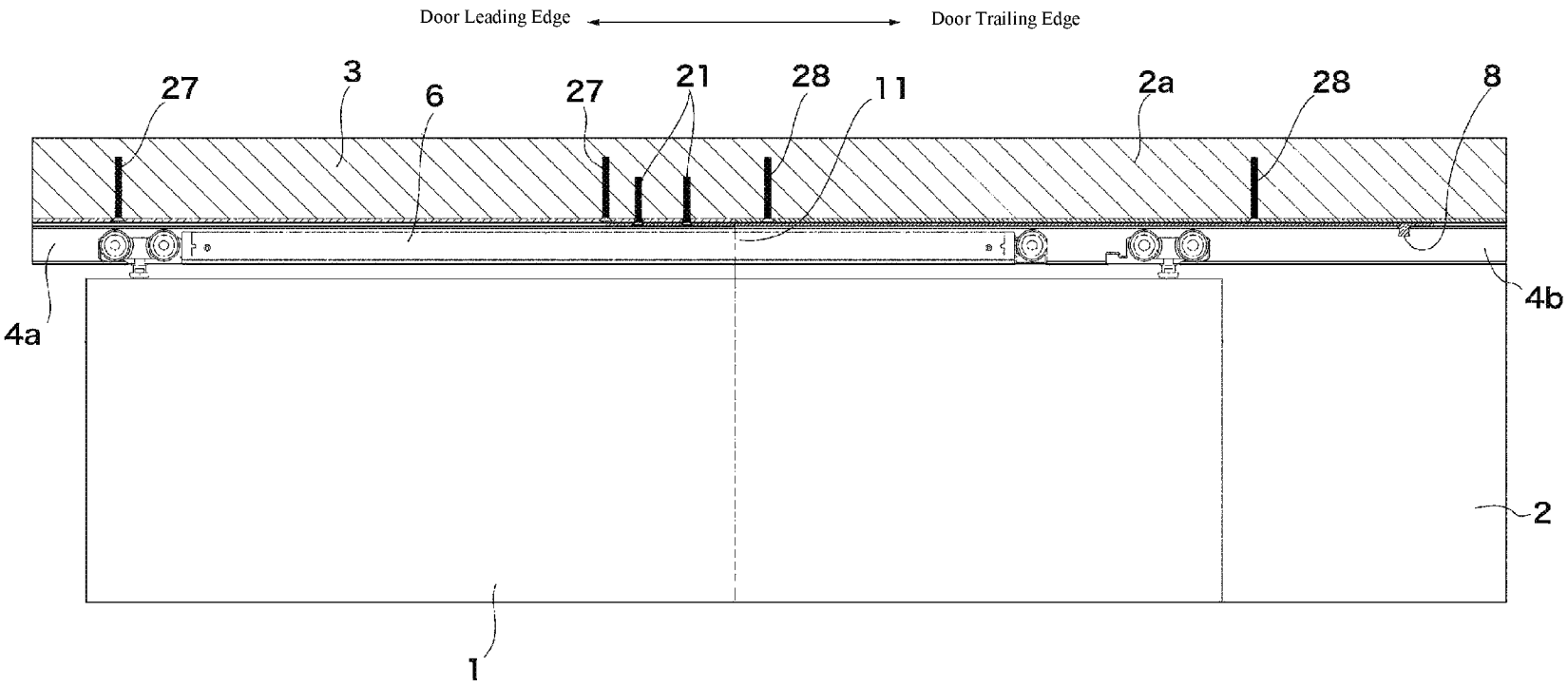
FIG. 11 is an enlarged view of the sliding door closer set of FIG. 10.

FIG. 10 and FIG. 11 show cross-sectional views along the rail 4 of a door pocket type sliding door 1. As shown in the enlarged view of FIG. 11, the inner rail 4*b* is mounted to the upper frame 2*a* of the door pocket 2 by a fastening member 28. The outer rail 4*a* is mounted to the upper frame 3 outside the door pocket 2 by the fastening member 27. The trigger integrated plate 10 is mounted to the outer rail 4*a* by the fastening member 21. The door trailing edge side trigger 8 connected to the trigger integrated plate 10 is arranged at a predetermined position on the inner rail 4*b*.

According to the sliding door closer set of the present embodiment, the position of the trigger 8 arranged inside the door pocket 2 can be adjusted from outside of the door pocket 2, and therefore the position of the trigger 8 can be adjusted without demolishing the door pocket 2. Accordingly, the risk of having to demolish the door pocket 2 in order to adjust the position of the trigger 8 can be eliminated.

Moreover, even if a problem occurs with the trigger 8 or closer 6 after the sliding door closer set has been assembled, the trigger 8 and closer 6 can be removed by moving the trigger 8 and closer 6 to the outer rail 4*a* and removing the outer rail 4*a* from the upper frame. Therefore, maintenance and inspection of the trigger 8 and closer 6 can be easily performed.

Furthermore, because the trigger 8 can be arranged inside the door pocket 2 from outside of the door pocket 2, the sliding door closer set can be later assembled to an existing door pocket type sliding door 1.

Figure 12A:
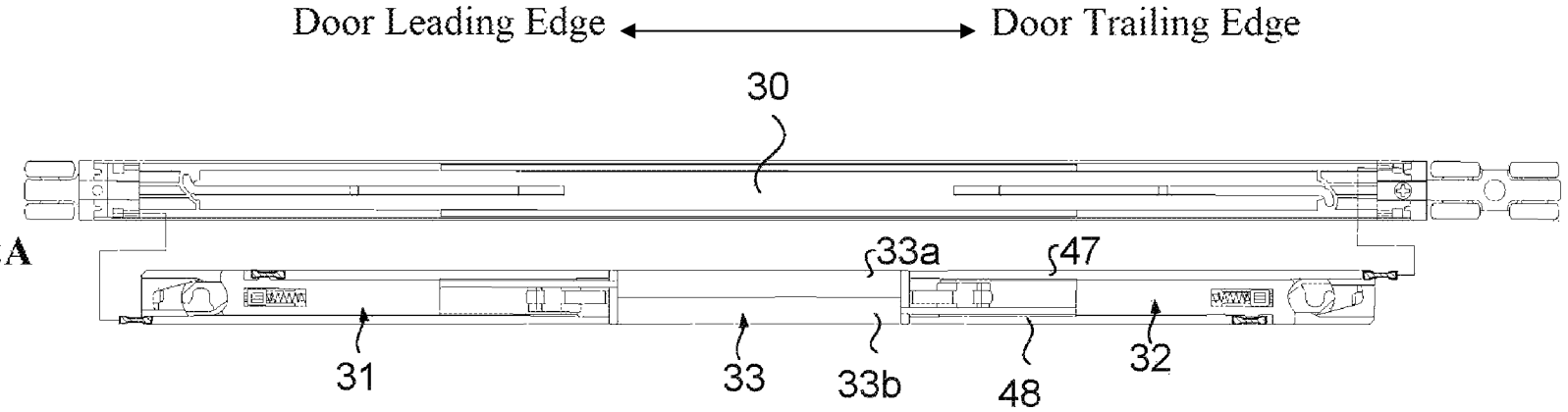
FIGS. 12A and 12B are detailed views of a closer
Figure 12B:
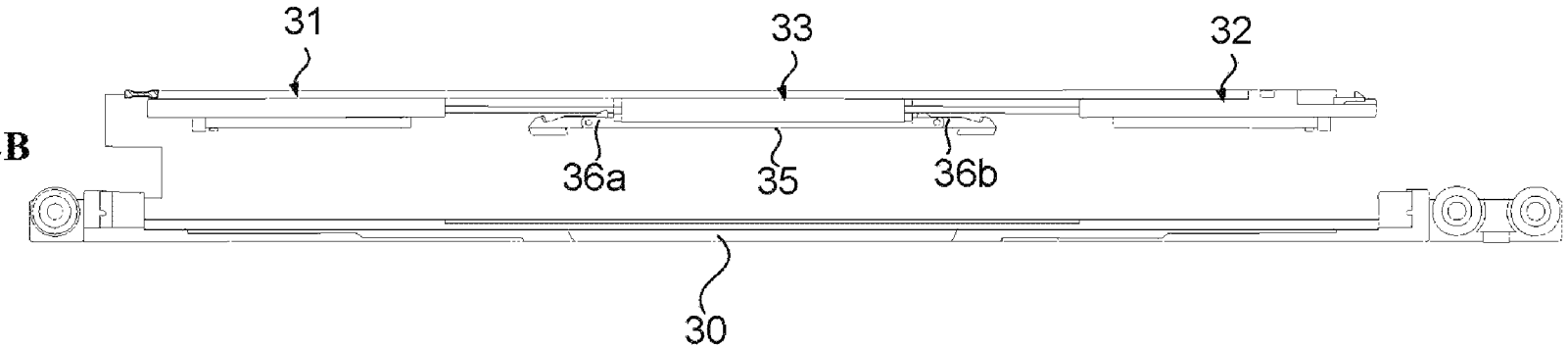

One example of a structure of the closer 6 is as follows. FIG. 12A shows a plan view of the closer 6, and FIG. 12B shows a side view of the closer 6. The closer 6 comprises the base 30 extending in a long and narrow manner in one direction, the first slider assembly 31 provided at one end in the longitudinal direction of the base 30, the second slider assembly 32 provided at the other end in the longitudinal direction of the base 30, and the damper assembly 33 arranged between the first slider assembly 31 and the second slider assembly 32. The first slider assembly 31 pulls the sliding door 1 in the door trailing edge direction. The second slider assembly 32 pulls the sliding door 1 in the door leading edge direction. The damper assembly 33 damps the opening and closing operations of the sliding door 1. FIG. 12A and FIG. 12B show a state in which the first and second slider assemblies 31, 32 and the damper assembly 33 are removed from the base 30 of the closer 6. Note that the detailed structure of the closer 6 of the present embodiment is described in JP 5285679 B proposed by the applicant.

Figure 13A:
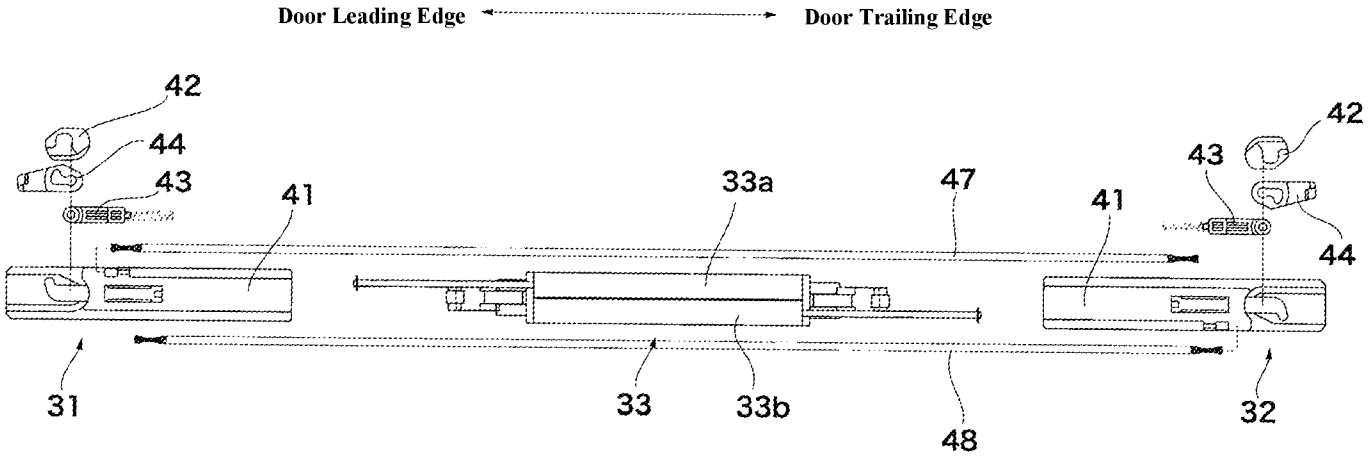
FIGS. 13A and 13B are exploded views of a first and second slider assemblies and damper assembly of a closer
Figure 13B:
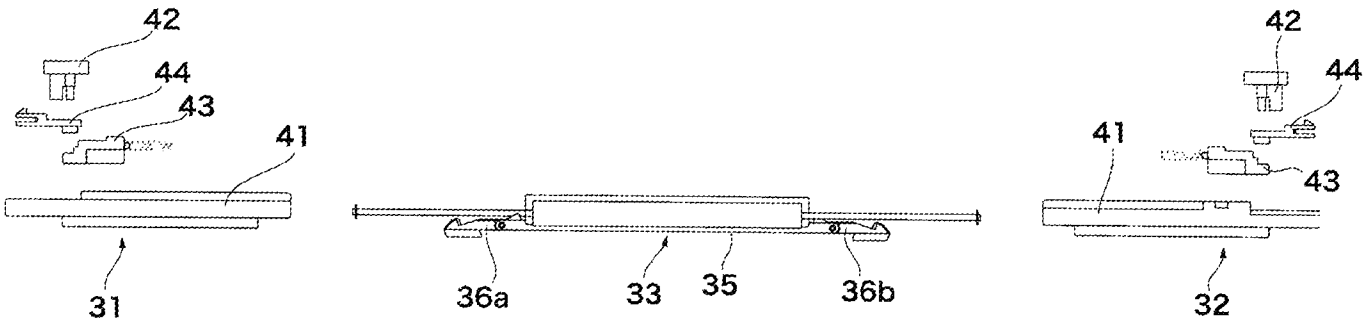

FIGS. 13A and 13B show an exploded view of the first and second slider assemblies 31, 32 and the damper assembly 33. FIG. 13A is a plan view, and FIG. 13B is a side view. The first slider assembly 31 comprises a first slider 41, a trigger catcher 42, a trigger pusher 43, and a malfunction prevention cam 44. The trigger catcher 42 captures the door trailing edge side trigger 8. The trigger catcher 42 is supported by the trigger pusher 43 so as to be rotatable in the horizontal plane. The malfunction prevention cam 44 is also supported by the trigger pusher 43 so as to be rotatable in the horizontal plane. A pulling coil spring 47 as an elastic body is bridged between the base 30 and the first slider assembly 31.

As shown in FIG. 12A, before the closer 6 operates, the first slider assembly 31 is located at a lock position at the end in the door trailing edge side of the base 30. The trigger pusher 43 holds the lock position of the first slider assembly 31. When the closer 6 engages with the door trailing edge side trigger 8, or in other words, when the trigger catcher 42 abuts the door trailing edge side trigger 8, the trigger catcher 42 rotates, and the lock between the first slider assembly 31 and the base 30 is released. Furthermore, the first slider assembly 31 slides with respect to the base 30 by the pulling force of the pulling coil spring 47. Because the trigger catcher 42 captures the door trailing edge side trigger 8, the position of the first slider assembly 31 does not change, and the base 30 slides in the door trailing edge direction. As a result, the sliding door 1 hung from the base 30 is pulled in the door trailing edge direction.

The malfunction prevention cam 44 is provided in order to return the first slider assembly 31 to the lock position. When the first slider assembly 31 is away from the lock position due to malfunction, the trigger catcher 42 cannot capture the door trailing edge side trigger 8. Even in such a case, the malfunction prevention cam 44 captures the door trailing edge side trigger 8, and therefore the first slider assembly 31 can be returned to the lock position.

Similar to the first slider assembly 31, the second slider assembly 32 comprises a second slider 41, a trigger catcher 42, a trigger pusher 43, a malfunction prevention cam 44, and a pulling coil spring 48. The structure of each component is the same as the structure of each component of the first slider assembly 31, and therefore is provided with the same reference numeral, and explanations thereof are omitted.

As shown in FIGS. 12A and 12B, the damper assembly 33 is assembled so as to be slidable in the longitudinal direction in the base 30. The damper assembly 33 comprises a first linear damper 33*a*, a second linear damper 33*b*, and a damper base 35 at which the first and second linear dampers 33*a*, 33*b* are installed. The first linear damper 33*a* is bridged between the first slider assembly 31 and the damper base 35. The second linear damper 33*b* is bridged between the second slider assembly 32 and the damper base 35. A damper lock 36*a* for the first slider and a damper lock 36*b* for the second slider are provided at the damper base 35 so as to be rotatable in the vertical plane.

When the first slider assembly 31 slides with respect to the base 30, the space between the damper base 35 and the first slider assembly 31 reduces, and the first linear damper 33*a* generates a damping force. When the first slider assembly 31 abuts the damper base 35, the engagement between the damper lock 36*a* for the first slider and the base 30 is released. The damper base 35 slides together with the first slider assembly 31, the space between the second slider assembly 32 and the damper base 35 is reduced, and the second linear damper 33*b* generates a damping force. In other words, when the first slider assembly 31 slides with respect to the base 30, initially the first linear damper 33*a* operates, and then next, the second linear damper 33*b* operates. When the second slider assembly 32 slides with respect to the base 30, opposite of the above description, initially the second linear damper 33*b* operates, and then next, the first linear damper 33*a* operates.

Note that the present invention is not limited to the above-mentioned embodiment, but may be modified in various embodiments without departing from the scope of the present invention.

In the above-mentioned embodiment, an example of a dual type closer which pulls a sliding door in both the door leading edge direction and the door trailing edge direction was described, but a single type closer that pulls a sliding door in only one of either the door leading edge direction or the door trailing edge direction can be used. The structure of the closer of the above-mentioned embodiment is one example, and closers of other structures can be used as long as the closer is capable of pulling the sliding door in at least one of the door leading edge direction and the door trailing edge direction.

In the above-mentioned embodiment, the boundary line between the inner rail and the outer rail is made to match with an end part in the door leading edge direction of the door pocket, but the boundary line may also be shifted from the end part in the door leading edge direction of the door pocket.

In the above-mentioned embodiment, the trigger integrated plate is mounted to the outer rail, but the inner rail may be extended to the outside of the door pocket, and then the trigger integrated plate may be mounted to the extended portion of the inner rail outside the door pocket.

In the above-mentioned embodiment, the inner rail and outer rail are separate from each other, but the inner rail and the outer rail may also be integrated.

In the above-mentioned embodiment, the trigger integrated plate was mounted to the rail by a screw, but in place of a screw, a rivet which can be caulked and fixed, a pin which can be caulked and fixed, a snap fit design which uses the elasticity of projection to fit and secure a concave part provided on a component into a recess part on the receiving side, an adhesive, or the like can be used as a fastening member.

The present specification is based on Japanese Patent Application No. 2014-038193 filed on Feb. 28, 2014. The entire content thereof is incorporated herein.

REFERENCE NUMERALS

1 . . . sliding door
2 . . . door pocket
4 . . . rail
4*a* . . . outer rail
4*b* . . . inner rail
6 . . . closer
7 . . . door leading edge side trigger
8 . . . door trailing edge side trigger
10 . . . trigger integrated plate
11 . . . boundary line
15 . . . guide unit
21 . . . fastening member

What is claimed is:

1. A sliding door closer set comprising:

a rail arranged partially inside a door pocket;

a closer hanging a sliding door and being capable of moving along the rail; and a trigger arranged inside the door pocket;

wherein the sliding door is pulled into the door pocket with a pulling force of a coil spring provided in the closer as a result of engagement between the trigger and the closer, which has moved to a predetermined position on the rail; and the sliding door closer set further comprises a trigger integrated plate mounted to the rail outside the door pocket and integrally connected to the trigger arranged inside the door pocket, the trigger integrated plate is provided with a mounting part for mounting to the rail outside the door pocket, and when the sliding door is stored inside the door pocket, the trigger is located between traveling bodies, and a length of the trigger integrated plate from an edge outside the door pocket to the trigger is shorter than a length of the rail outside of the door pocket;

wherein when a trigger catcher captures the trigger arranged inside the door pocket in a state that the trigger integrated plate is mounted to the rail by a fastening member, the pulling force of the coil spring in the closer causes the sliding door to slide relative to the trigger catcher while the trigger catcher is capturing the trigger, so that the sliding door is pulled into the door pocket;

wherein after the sliding door is pulled into the door pocket by the coil spring of the closer, the fastening member is configured to be disconnected from the rail such that the trigger integrated plate is not mounted to the rail;

in a state that the trigger integrated plate is not mounted to the rail and the trigger is captured in the trigger catcher, movement of the sliding door from outside of the door pocket causes the predetermined position of the trigger to be adjusted;

after the predetermined position of the trigger is adjusted, the fastening member is configured to be reconnected to the rail such that the trigger integrated plate is again mounted to the rail.

2. The sliding door closer set according to claim 1, wherein a guide unit for guiding the trigger integrated plate is formed in the rail such that the trigger integrated plate can be inserted into and removed from the rail.

3. A sliding door closer set comprising:

a rail arranged partially inside a door pocket;

a closer hanging a sliding door and being capable of moving along the rail; and a trigger arranged inside the door pocket;

wherein the sliding door is pulled into the door pocket with a pulling force of a coil spring provided in the closer as a result of engagement between the trigger and the closer, which has moved to a predetermined position on the rail; and the sliding door closer set further comprises a trigger integrated plate mounted to the rail outside the door pocket and integrally connected to the trigger arranged inside the door pocket, the trigger integrated plate is provided with a mounting part for mounting to the rail outside the door pocket, and the rail comprises an outer rail located outside the door pocket and an inner rail located inside the door pocket, and the inner rail and outer rail are separate from each other, and a length of the trigger integrated plate is shorter than a length of the outer rail;

wherein when a trigger catcher captures the trigger arranged inside the door pocket in a state that the trigger integrated plate is mounted to the rail by a fastening member, the pulling force of the coil spring in the closer causes the sliding door to slide relative to the trigger catcher while the trigger catcher is capturing the trigger, so that the sliding door is pulled into the door pocket;

wherein after the sliding door is pulled into the door pocket by the coil spring of the closer, the fastening member is configured to be disconnected from the rail such that the trigger integrated plate is not mounted to the rail;

in a state that the trigger integrated plate is not mounted to the rail and the trigger is captured in the trigger catcher, movement of the sliding door from outside of the door pocket causes the predetermined position of the trigger to be adjusted;

after the predetermined position of the trigger is adjusted, the fastening member is configured to be reconnected to the rail such that the trigger integrated plate is again mounted to the rail.

4. The sliding door closer set according to claim 3, wherein a guide unit for guiding the trigger integrated plate is formed in the rail such that the trigger integrated plate can be inserted into and removed from the rail.

5. The sliding door closer set according to claim 3, wherein the trigger integrated plate straddles a boundary line between the outer rail and the inner rail.

6. The sliding door closer set according to claim 4, wherein the trigger integrated plate straddles a boundary line between the outer rail and the inner rail.

* * * * *